US006901874B2

(12) United States Patent
Lo

(10) Patent No.: US 6,901,874 B2
(45) Date of Patent: Jun. 7, 2005

(54) RETRACTABLE HORN CLEAT DEVICE

(75) Inventor: Nico Lo, Hsin-Chu (TW)

(73) Assignee: Hsiang Tzer Enterprise Co., Ltd., Hsin-Chu (TW)

( * ) Notice: Subject to any disclaimer, the term of this patent is extended or adjusted under 35 U.S.C. 154(b) by 0 days.

(21) Appl. No.: 10/686,605

(22) Filed: Oct. 17, 2003

(65) Prior Publication Data

US 2005/0082437 A1 Apr. 21, 2005

(51) Int. Cl.[7] ..... B63B 21/04
(52) U.S. Cl. ..... 114/218; 410/107
(58) Field of Search ..... 248/499, 507–509; 114/218; 410/107, 101, 111

(56) References Cited

U.S. PATENT DOCUMENTS 4,820,093 A * 4/1989 Hirakui et al. ..... 410/107
4,890,566 A * 1/1990 Morris ..... 114/218
4,945,849 A * 8/1990 Morris et al. ..... 114/218
5,004,388 A * 4/1991 Harris ..... 410/107
5,444,897 A * 8/1995 Gross ..... 24/265 CD
6,125,779 A * 10/2000 Czipri ..... 114/218
6,651,576 B1 * 11/2003 Lo ..... 114/218

FOREIGN PATENT DOCUMENTS

DE 29602596 U * 6/1997

* cited by examiner

*Primary Examiner*—Korie Chan
(74) *Attorney, Agent, or Firm*—Rosenberg, Klein & Lee

(57) ABSTRACT

A retractable horn cleat device with a seat body having a receiving cavity inside, a retractable handle provided in the seat body and slidingly displaceable upward and downward by the biasing action of two springs, and a coupling member connected to the retractable handle and coupled to a track on a driving plate inside the receiving cavity. The coupling member serves to guide the retractable handle along the track thereby allowing a user to selectively lock the retractable handle in either a retracted configuration or an unretracted configuration similar to a conventional horn cleat.

8 Claims, 10 Drawing Sheets

RETRACTABLE HORN CLEAT DEVICE

BACKGROUND OF THE INVENTION

1. Field of the Invention

The present invention is directed to nautical hardware, and more particularly to nautical holdfast devices and, even more particularly, to a retractable horn cleat device that can be stowed flush with a deck or other surface upon which it is mounted when not in use.

2. Description of the Related Art

Horn cleats are usually positioned peripherally on a deck, generally in proximity to the ship's gunwales. They are used to secure cargo and other objects on board and are also adapted to belay hawsers when the boat is berthed at a dock.

As shown in FIG. 1, a conventional horn cleat structure for a boat comprises a transverse rod 10 and two vertical rods 12 connected below the transverse rod 10. The transverse rod 10 is often fixedly secured both to the two vertical rods 12 and to a boat deck 16 with two screw bolts 14 passing through the two vertical rods 12.

When cleats are used to lash down cargo, the line is wound around the cargo, and the two ends of the line are belayed respectively to different cleats thereby substantially immobilizing the cargo and preventing the cargo from loosening, shifting weight, or otherwise moving. When the ship is docked, one end of the line is belayed to the cleat on board, while the other end of the line is cleated at the dock, thereby making fast the boat to prevent it from slipping its mooring and drifting away.

However, currently available conventional cleats protrude from the surface of the boat deck, or any other surface on which such cleats are fixedly mounted. The consequent problems are that the horn cleats of the prior art not only take up some of the limited space on a boat deck, but constitute a safety hazard, potentially causing persons to trip, stumble, stub toes, injure feet, and the like.

Furthermore, insofar as conventional cleats are fixed objects protruding from the deck, the available and suitable installation positions are rather limited. They are typically installed on the outer aspects of the deck periphery to stay as clear as possible of passageways and similarly busy places.

Accordingly, these and related problems of conventional horn cleats of the prior art are substantially overcome by the retractable horn cleat device of the subject invention.

SUMMARY OF THE INVENTION

An important object of the present invention is to provide a retractable horn cleat device that can be conveniently deployed for use and can then be conveniently retracted and stowed when not in use.

Another object of the present invention is to provide a retractable horn cleat device for boat, one which minimizes the risk of people tripping, falling and otherwise being injured by a cleat.

Another object of the present invention is to provide a retractable horn cleat device, which can be installed at any convenient place because of its retractable concealable structure.

To achieve the above goals, the retractable horn cleat device is comprised of a seat body, a retractable handle, two biasing components, a driving plate, and a coupling member. The seat body has a receiving cavity inside. The retractable handle longitudinally connects onto the seat body, and can slide up and down upon the seat body in which the handle's two vertical rods are telescopingly received. The biasing components are disposed in the sliding direction between the vertical rods of the retractable handle and the seat body.

The driving plate is disposed in the receiving cavity of the seat body. The driving plate is formed with a longitudinal track that has two substantially V-shaped sections. The coupling member is connected to the retractable handle and coupled to the track at the driving plate and adapted to guide movement of the retractable handle along the track and to selectively lock the retractable handle in either the unretracted operative position or the retracted non-operative position.

DETAILED DESCRIPTION OF THE PREFERRED EMBODIMENT

Figure 1:
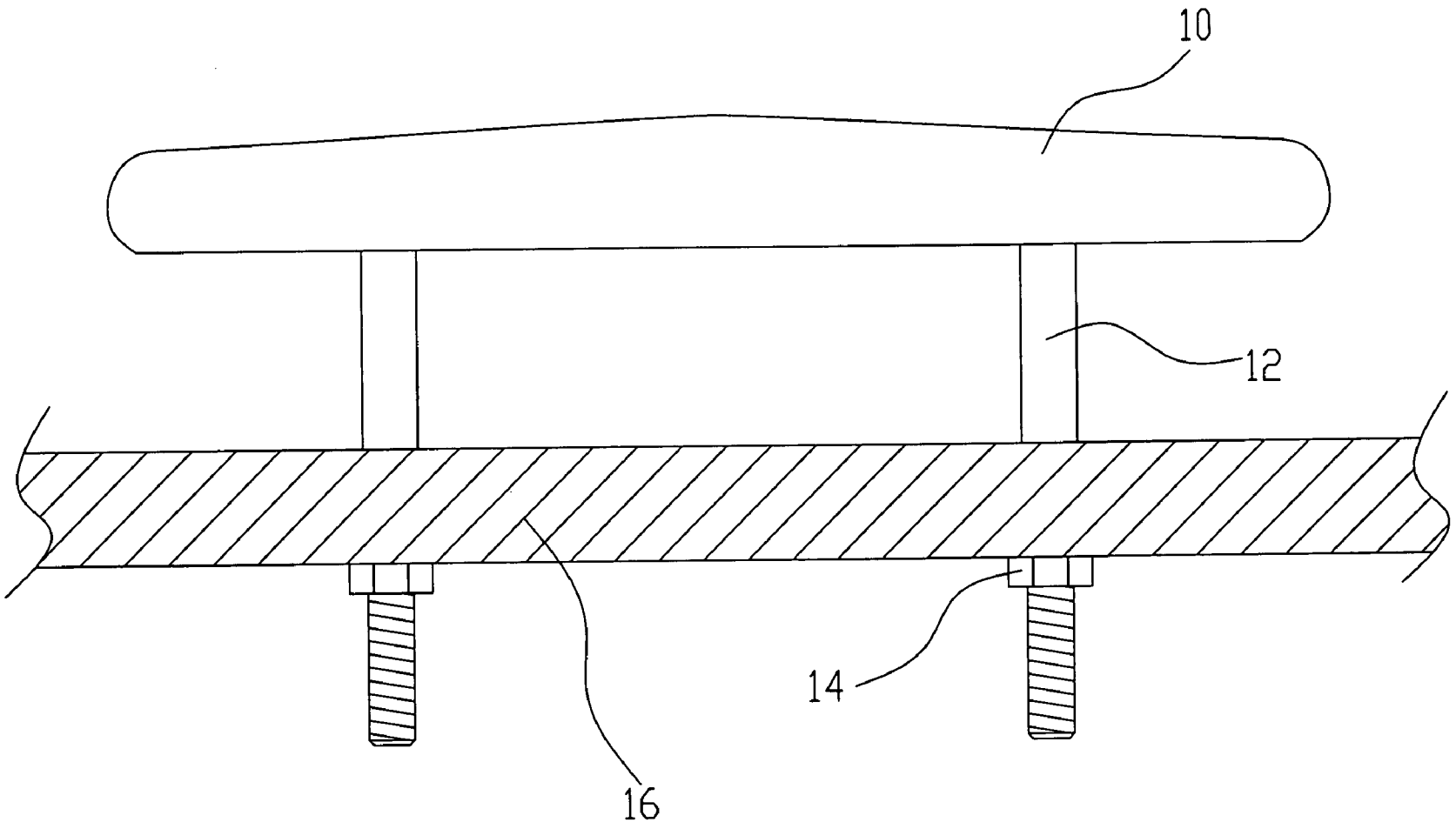
FIG. 1 (Prior Art)
FIG. 1 is a front view of a conventional horn cleat device.
Figure 2:
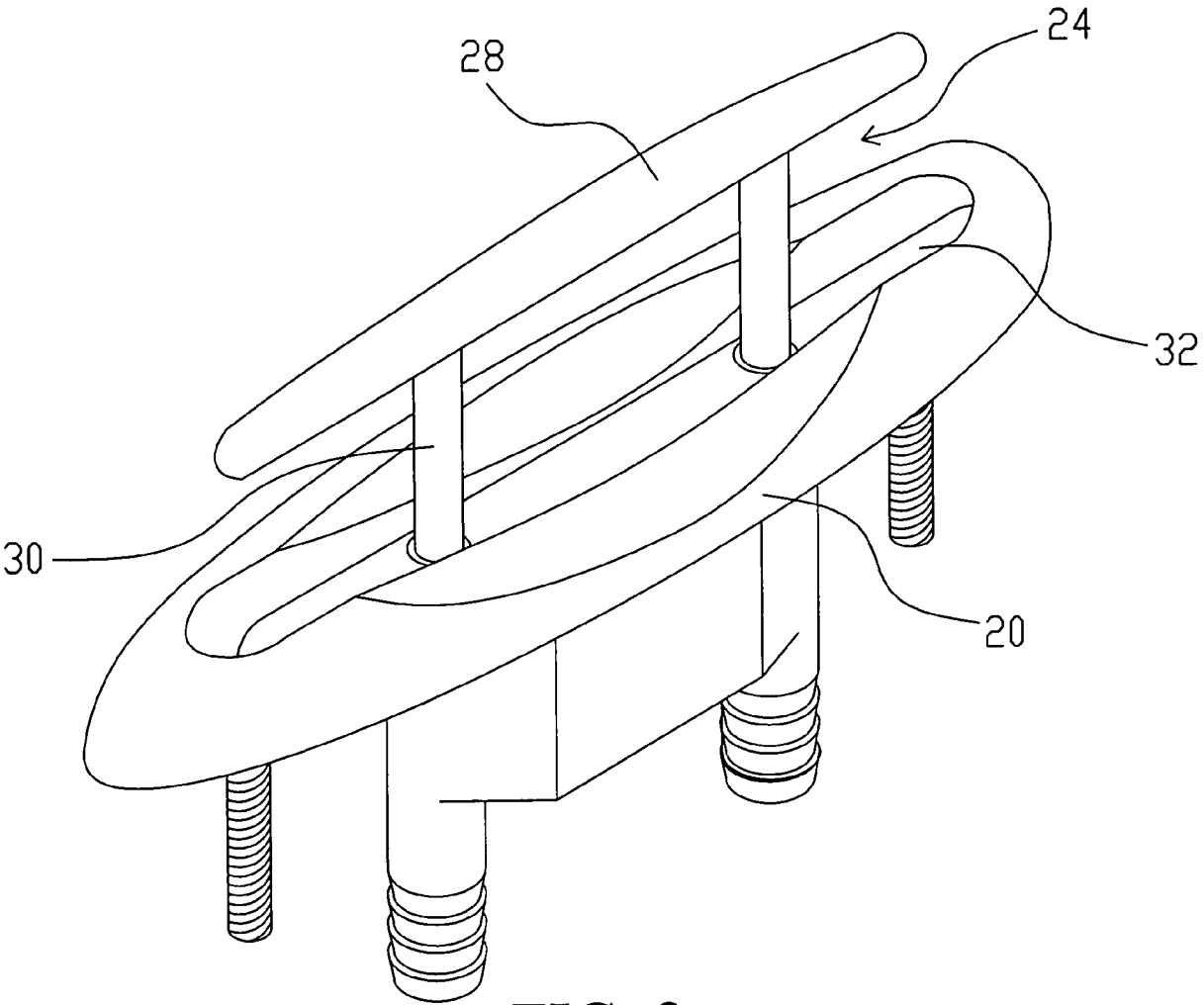
FIG. 2 is a perspective view of a retractable horn cleat device according to the present invention.
Figure 3:
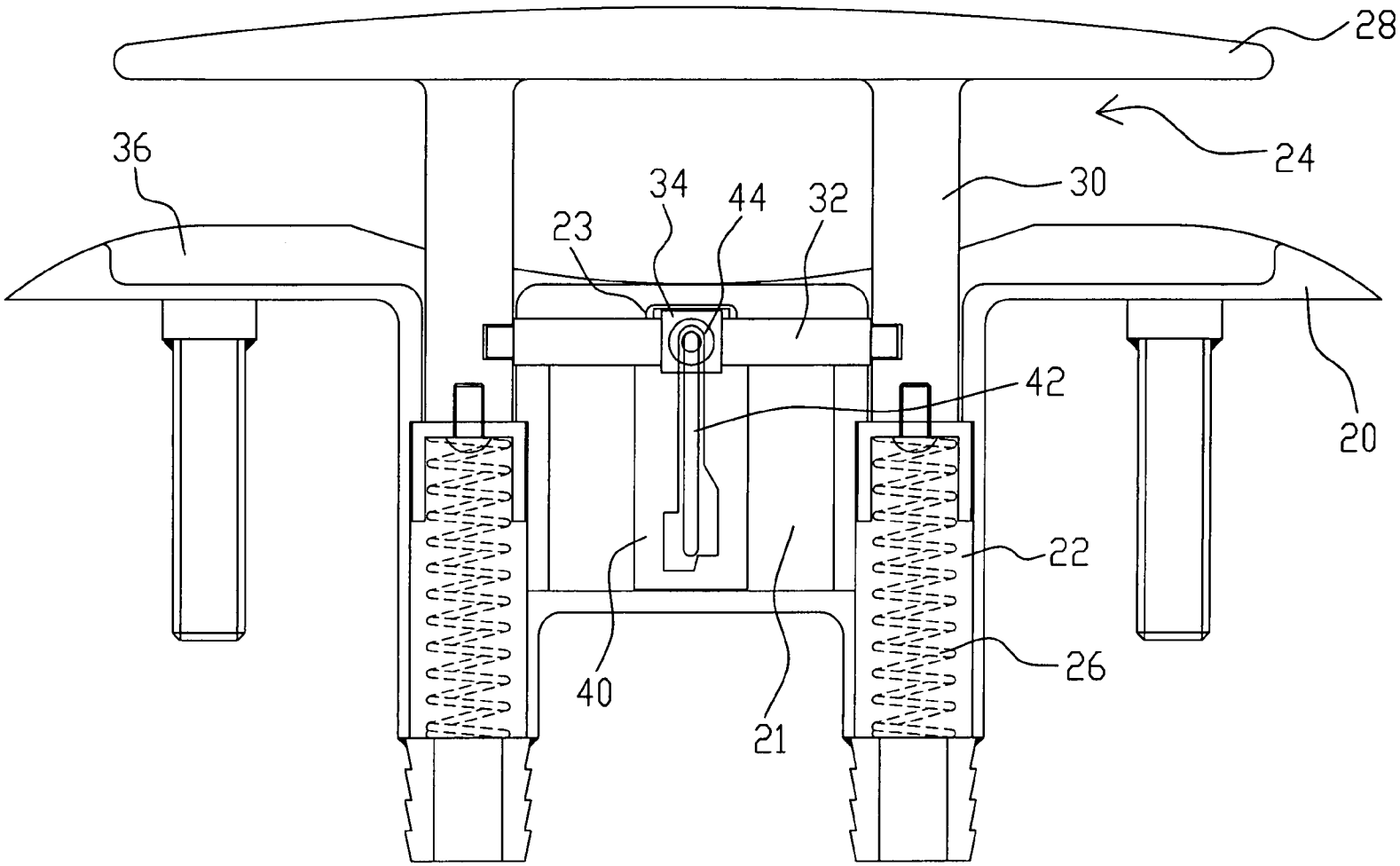
FIG. 3 is a front sectional view of a retractable horn cleat device according to the present invention.

As shown in FIGS. 2 and 3, a retractable horn cleat device comprises a seat body 20 having a receiving cavity 21 therein. A recess 23 is further provided at the inside top of the receiving cavity 21. Two longitudinal holes 22 are vertically formed and disposed in the seat body 20 at two opposite sides of the receiving cavity 21.

A retractable handle 24 longitudinally connects to the seat body 20 in which the handle's two vertical rods are telescopingly received, and can be slid up and down on the seat body 20. Two biasing components, preferably being springs 26, are disposed in the sliding longitudinal direction between the pair of vertical rods of the retractable handle 24 and the seat body 20.

The retractable handle 24 comprises a transverse rod 28 and two vertical rods 30 fixedly attached to the inferior aspect of the transverse rod 28. A cross-bar 32 is transversely connected between the two vertical rods 30. A square block 34 through which the cross-bar 32 passes is pivotally connected to the coupling member 44. The square block 34 has a form corresponding to the recess 23 of the receiving cavity 21 in which it is receivedly seated when the retractable handle is in the unretracted configuration.

The retractable handle 24 has the two vertical rods 30 that connect to the upper aspects of the springs 26 that are disposed in the sliding direction in the vertical holes 22 of the seat body 20. A slidable connection is thus formed between the retractable handle 24 and the seat body 20.

A groove 36 is formed at the top of the seat body 20 corresponding to the position exactly below the transverse rod 28 of the retractable handle 24 and adapted to receive and conceal the transverse rod 28 therein.

A recess 23 is provided at the inside top of the receiving cavity21 and adapted so that the upper part of the block 34 connected to the cross-bar 32 is seated in the recess 23 when the cross-bar 32 is moved upward and makes contact with the top of the receiving cavity 21.

Figure 4:
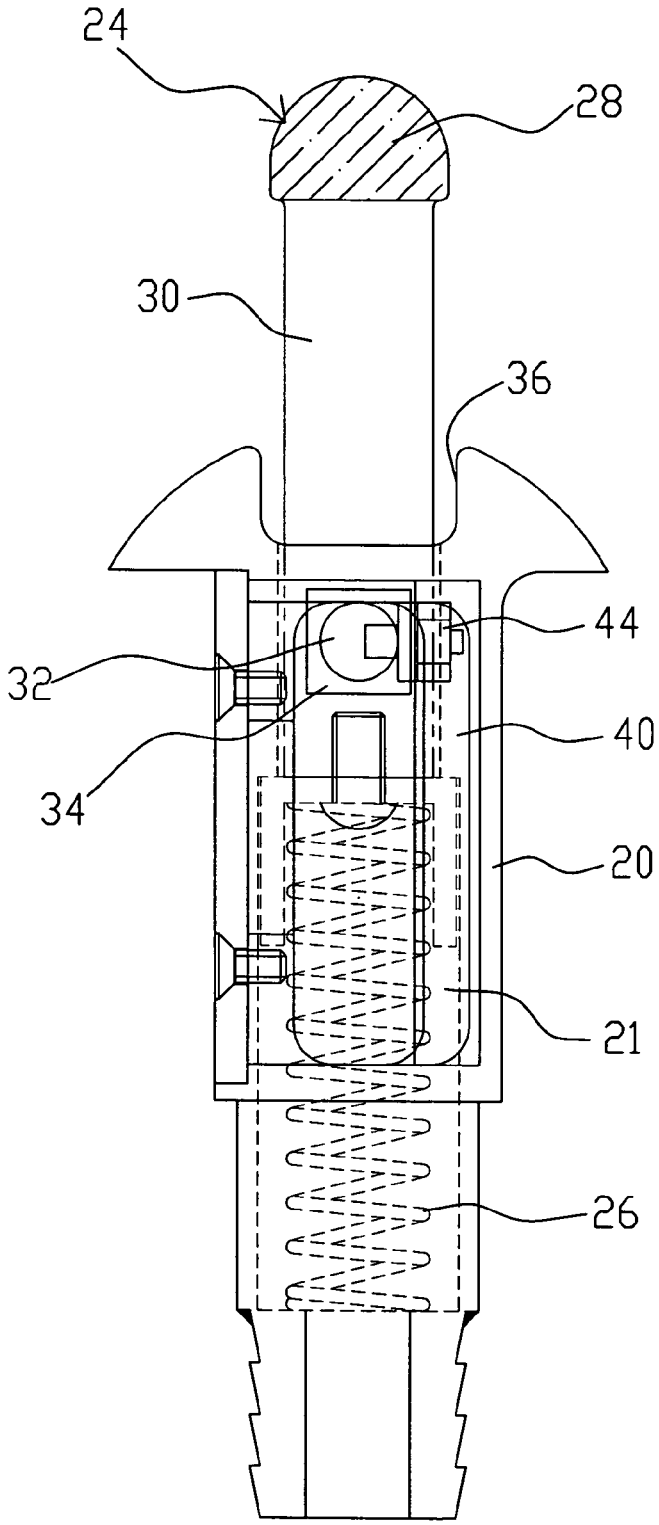
FIG. 4 is a side sectional view of FIG. 3.
Figure 5:
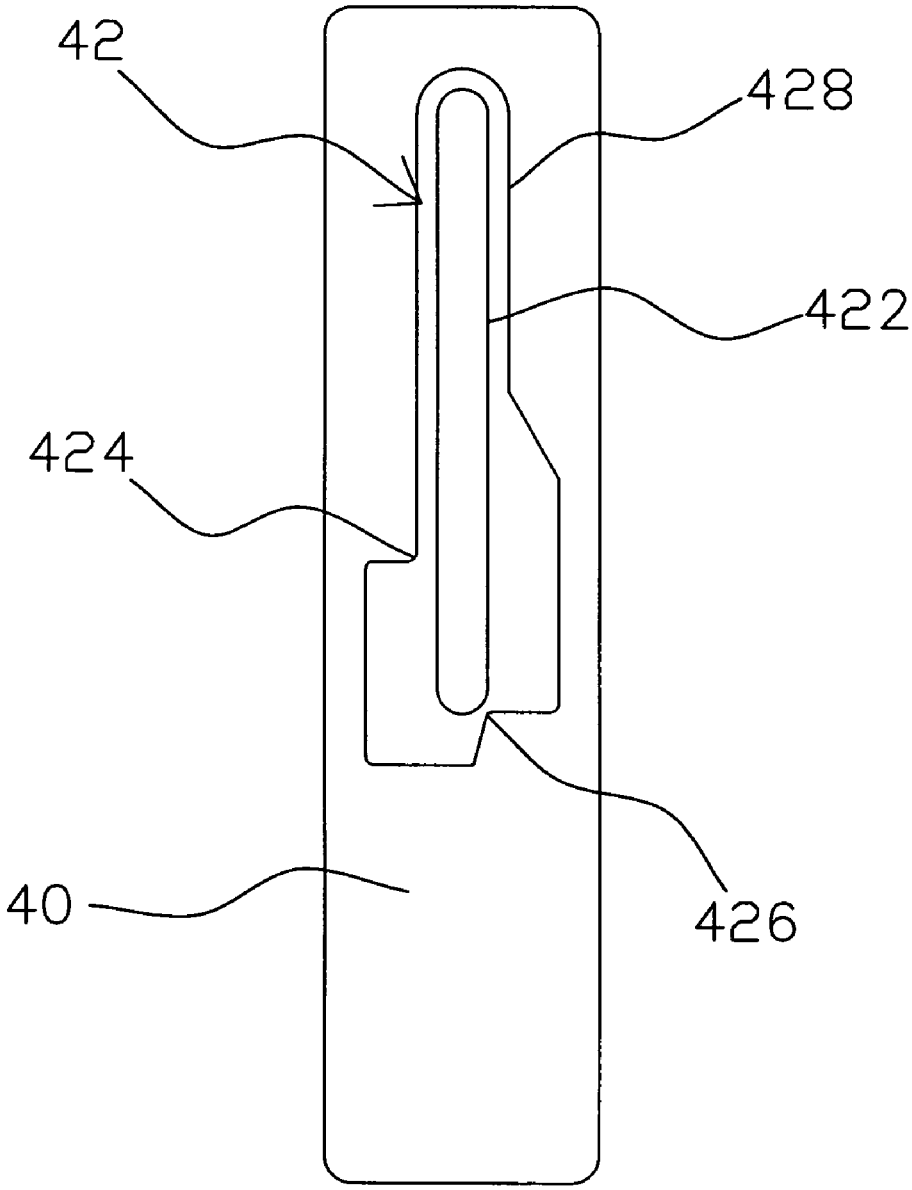
FIG. 5 is an isolated schematic view of the driving plate for the retractable horn cleat device of the present invention.

A driving plate 40 is disposed in the receiving cavity 21 of the seat body 20. As may be seen in FIG. 4, the driving plate 40 has a longitudinal track 42 formed therein. As illustrated in FIG. 5, the track 42 comprises a longitudinally extended deep groove 422, and a shallow groove. The track is formed with an inverted-U-shaped upper positioning section 428 corresponding in proximity to the upper part of the center groove 422, and a substantially V-shaped lower positioning section 424 oriented downwardly from the upper positioning section 428 corresponding in proximity to the left side of the lower part of the center groove 422. A substantially V-shaped lower guide section 426 is oriented upwardly from one end of the lower positioning section 424 corresponding in proximity to the right side of the lower part of the center groove 422 and in continuity with the other end of the upper positioning section 428.

Figure 6:
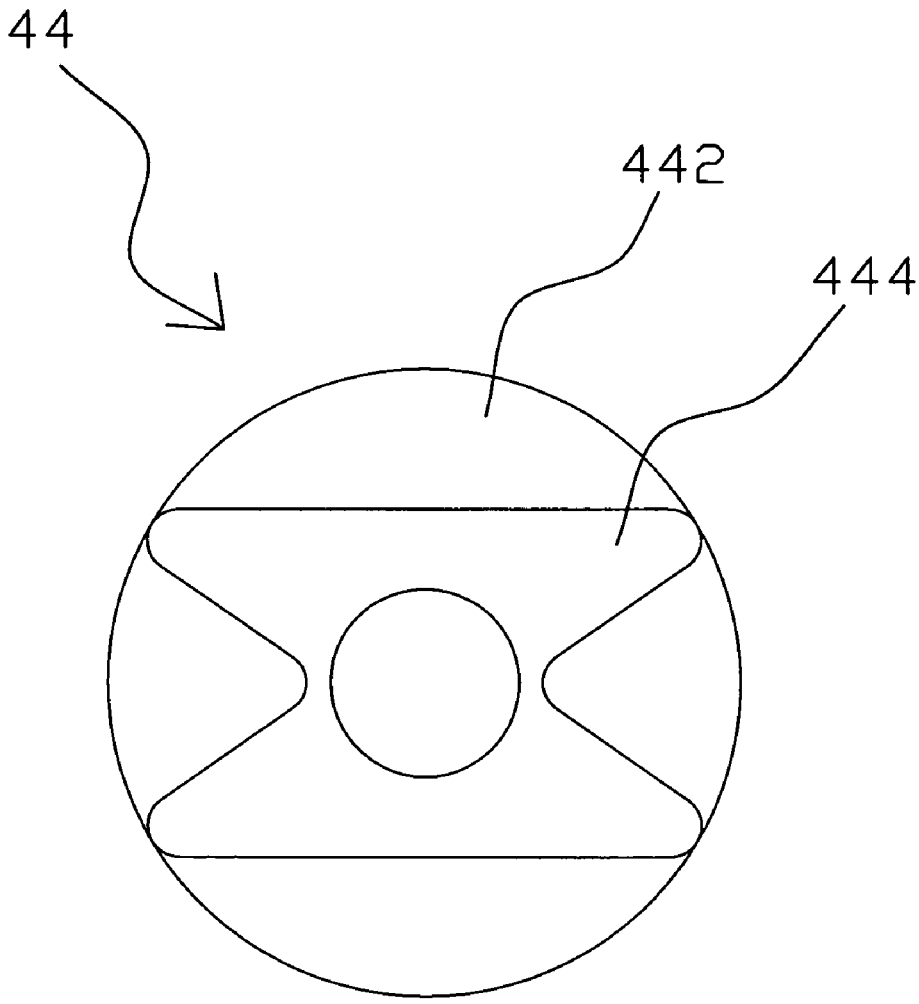
FIG. 6 is an isolated schematic view of the coupling member of the retractable horn cleat device of the present invention.

A coupling member 44 is composed of a guide disk 442 and a butterfly control block 444 pivotally mounted thereon, as may be seen in FIG. 6. One side of the coupling member 44 is connected to the block 34 through which passes the cross-bar 32, and the other side is slidingly coupled to the center groove 422 of track 42 and thereby adapted to constrain the vertical movement of the retractable handle 24 along the track 42.

A butterfly control block 444 fastened pivotally to the guide disk 442 is adapted to control movement and positioning of the coupling member 44 in the track 42. The butterfly control block 444 can be moved vertically along the center groove 422 only when the two opposite long sides of the butterfly control block 444 are maintained in parallel orientation relative to the upper positioning section 428.

When a user presses the retractable handle 24 downwards from the unretracted operative position to the retracted non-operative position, the butterfly control block 444 is stopped in the lower positioning section 424 to securely maintain the retractable handle 24 in the retracted non-operative position. When a user then presses the retractable handle 24 again, the butterfly control block 444 is disengaged from the lower positioning section 424 and is moved along the lower guide section 426 into the upper positioning section 428 (due to the upward pressure from each of the biasing compression springs 26) to hold the retractable handle 24 in the unretracted operative position.

In the above-mentioned structure, the cross-bar 32 is formed substantially as a cylinder that is connectedly seated at each of its ends in a receiving space formed in each of the vertical rods 42. The block 34 surrounding the cross-bar 32 that passes transversely therethrough is contained in the recess 23 when a user pulls the retractable handle 24 upward causes the cross-bar 32 to move upward until upward excursion of the cross-bar is stopped by its contact with the top of the receiving cavity 21. The bearing consists of the block 34 and the cross-bar 32 so that with the combined area of the block 34 and the cross-bar 32 the retractable horn cleat device can resist stronger pulling forces, as when used for securing lines.

Figure 7:
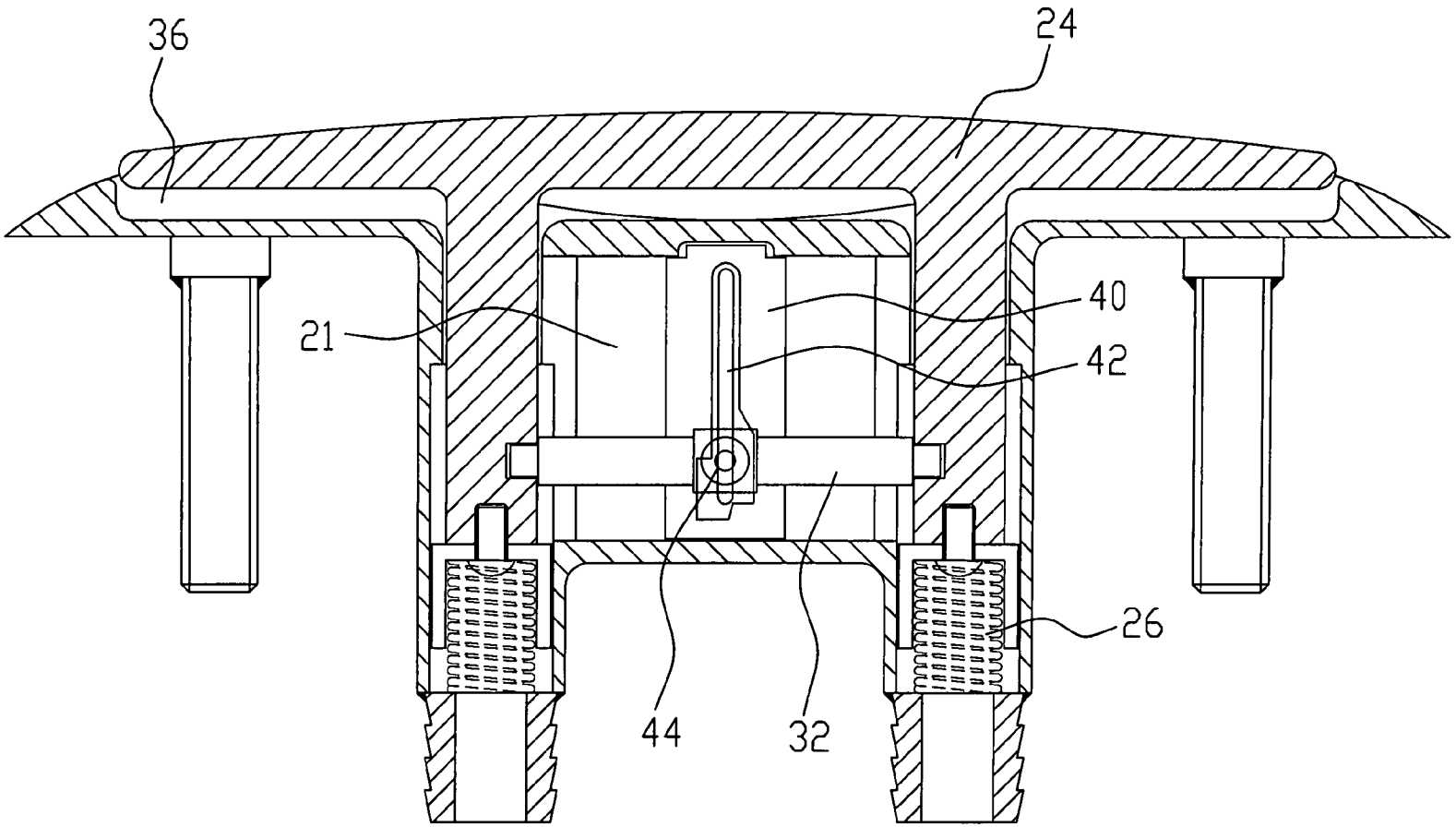
FIG. 7 is a front sectional view of the present invention, showing the retractable handle received inside the seat body.
Figure 8:
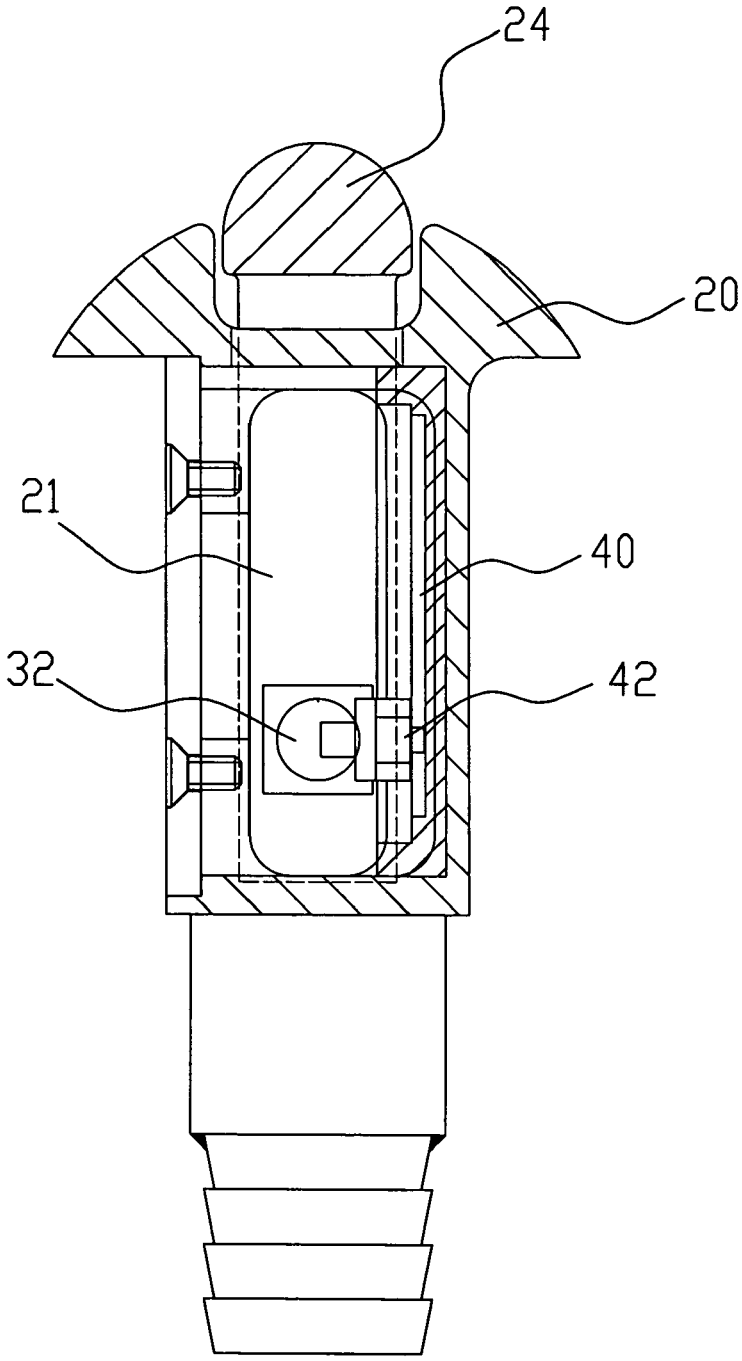
FIG. 8 is a side sectional view of the subject retractable horn cleat.
Figure 9:
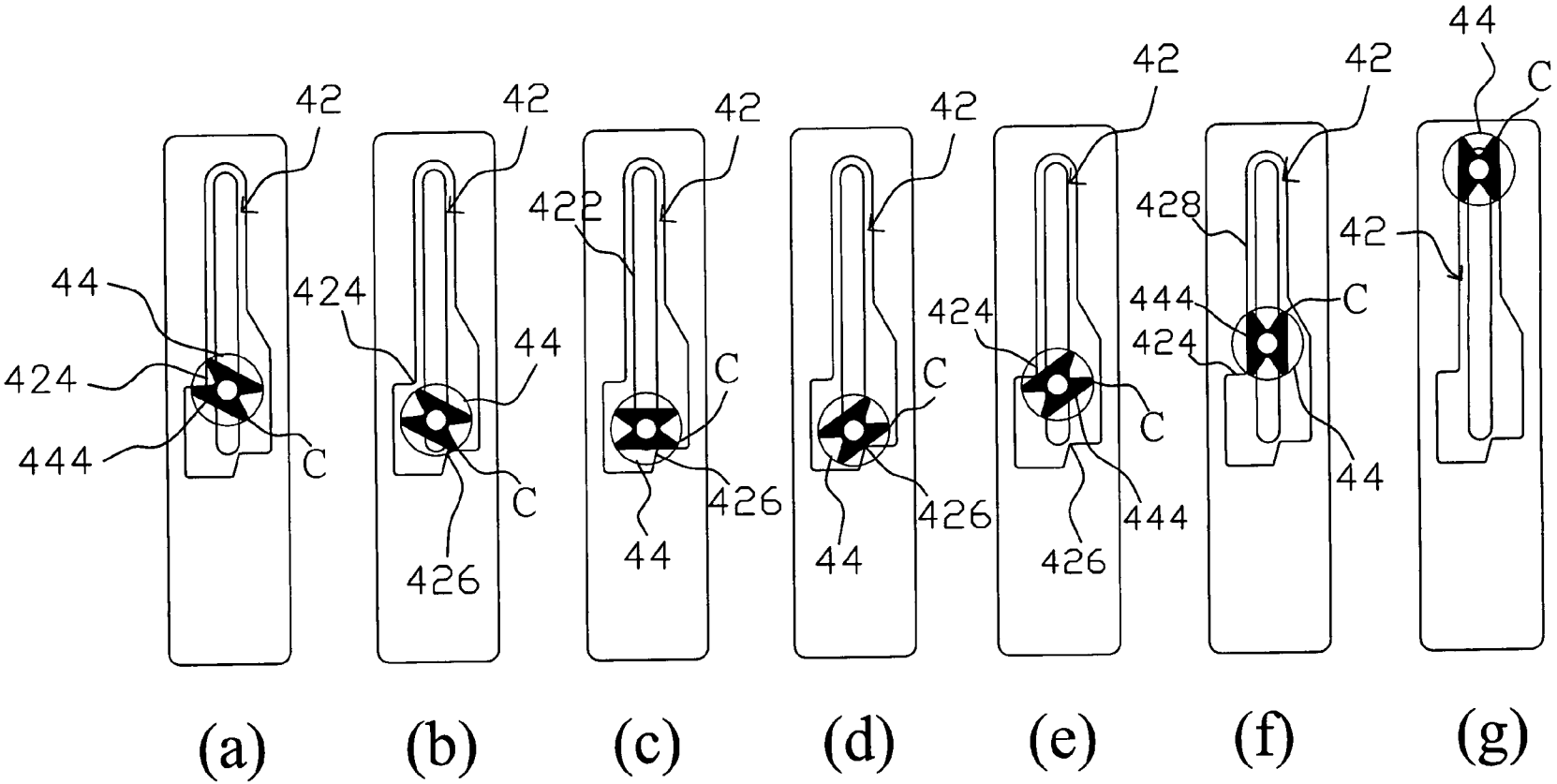
FIGS. 9(*a*) to 9(*g*) are a series of illustrative schematic views of the sequential action of the coupling member and the block relative to the track of the driving plate as the retractable handle moves from the retracted non-operative position to the unretracted operative position; and, FIGS. 10(*a*) to 10(*e*) are a series of illustrative schematic views of the sequential action of the coupling member and the block relative to the track of the driving plate when the retractable handle is moved from the unretracted operative position to the retracted non-operative position.

As shown in FIGS. 7 and 8, the retractable handle 24 of the retractable horn cleat device is usually in the retracted or stowed condition, a configuration of the coupling block 44 shown in FIG. 9(*a*). The movement of the butterfly control block 444 along the track is stopped in the lower positioning section 424 to maintain the coupling member 44 and block 34 in the lower positioning section 424.

When preparing to belay a line, it is only necessary to press the retractable handle 24 downwards. After the retractable handle 24 transfers the external force to the coupling member 44, as shown in FIG. 9(*b*), the point C of the butterfly control block 444 is forced into contact with a section of the lower guide section 426, thereby causing the butterfly control block 444 to be rotated counter-clockwise to the configuration shown in FIG. 9(*c*).

With sustained pressing on the retractable handle 24, the coupling member 44 and the block 44 34 move to the bottom end of the center groove 422. At this time, the butterfly control block 444 is forced against a section of the lower guide section 426 to rotate counter-clockwise to the configuration shown in FIG. 9(*d*). Upon releasing pressure from the retractable handle 24, the compression springs 26 bias the movable handle 24 vertically upwards as shown in FIG. 9(*e*). The butterfly control block 444 is then concomitantly forced against a part of the lower positioning section 424 to rotate counter-clockwise to the configuration shown in FIG. 9(*f*), enabling the coupling block 44 to move to the top end of the track 42 as shown in FIG. 9(*g*). At this time, the retractable handle 24 is extended out from the seat body 20, as shown in FIGS. 3 and 4. This is the unfolded, unretracted, or unstowed state.

Figure 10:
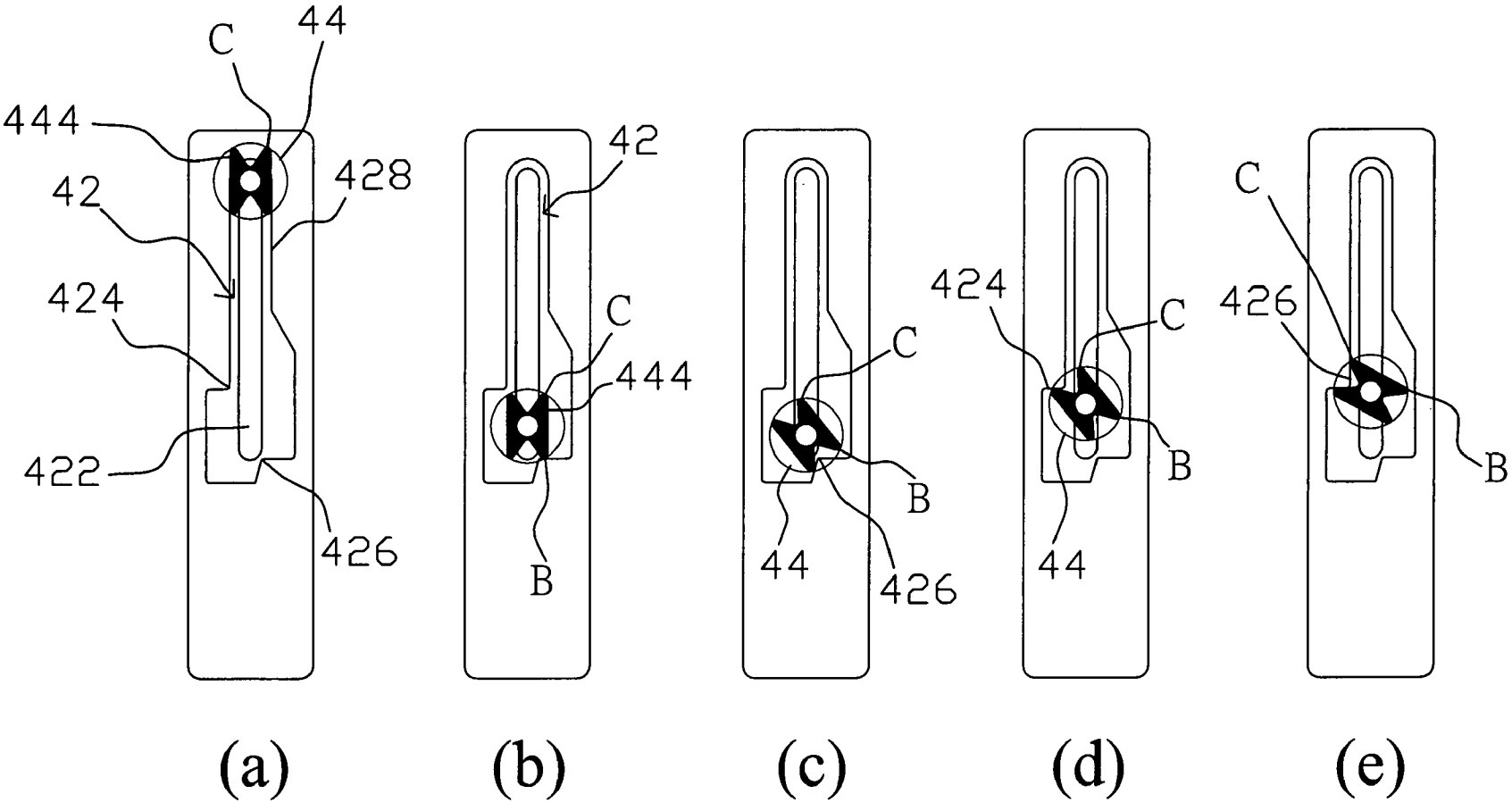

When a user no longer needs to belay a line a vertical downward force is applied to the retractable handle 24. Similarly, during a downward stroke of the retractable handle 24, the coupling member 44 and the block 34 are moved from the upper limit position as shown in FIG. 10(*a*) toward the position shown in FIG. 10(*b*). When the position shown in FIG. 10(*b*) is reached, section B of the butterfly control block 444 is forced against a part of the lower guide section 426, thereby causing the butterfly control block 444 to rotate counter-clockwise as shown in FIG. 10(*c*).

When pressure on the retractable handle 24 is released, the biasing components 26, which in the preferred embodiment are compression springs 26, immediately force the retractable handle 24 upwards. This causes the butterfly control block 444 to move against a part of the lower positioning section 424 as shown in FIG. 10(*d*) and then rotate counter-clockwise until point C is stopped at the lower positioning section 424 as shown in FIG. 10(*e*), at which point the retractable handle 24 is concealedly housed in the seat body 20. The above sequence of actions can be repeated as needed.

Although particular embodiments of the invention have been described in detail for purposes of illustration, various modifications and enhancements may be made without departing from the spirit and scope of the invention. Accordingly, the subject invention is not intended to be limited except as by the appended claims.

What the invention claimed is:

1. A retractable horn cleat device comprising:

a seat body having a receiving cavity formed therein;

a retractable handle longitudinally mounted in the seat body and adapted to slide up and down in the seat body between a retracted configuration and an unretracted configuration;

at least two biasing components slidingly disposed in a longitudinal direction between the retractable handle and the seat body;

a driving plate seated in the receiving cavity with a longitudinal track disposed thereon, said track comprising an upper position section, a substantially V-shaped positioning section upwardly disposed and a substantially V-shaped guiding section downwardly disposed, each V-shaped section having an angled edge, wherein the substantially V-shaped positioning and guiding sections are respectively positioned at opposing sides of the track so that the angled edges of the two V-shaped sections are respectively oriented toward an interior of the longitudinal track and are disposed at an oblique and eccentric position relative to a longitudinal axis of the track; and a coupling member with a first side connected to a cross-bar that is connected to the retractable handle, and an opposing second side slidably and rotatably disposed in the longitudinal track of the driving plate so as to permit the coupling member to be moved along the track from the retracted configuration where the coupling member engage the V-shaped positioning section such that the coupling member is obliquely angled, to the unretracted configuration where the coupling member is at the upper positioning section of the track, and wherein such movement is achieved by pressing the retractable handle and thereby causing the coupling member to rotatingly and slidingly move along a lower aspect of the track to the V-shaped guiding section where the coupling member is caused to rotate to a longitudinal orientation that permits the coupling member to move upward by an action of the two biasing components, thereby moving upward with the retractable handle to the unretracted configuration in which said retractable handle protrudes out of the seat body for use.

2. The retractable horn cleat device as claimed in claim 1, wherein said retractable handle comprises a transverse rod and two vertical rods connected thereto below said transverse rod, said two vertical rods of said retractable handle are connectedly seated on said two biasing components so that said each of said two biasing components is disposed in said seat body in a longitudinal sliding direction.

3. The retractable horn cleat device as claimed in claim 2, wherein a pair of vertical holes corresponding to said two vertical rods are longitudinally formed through said seat body to permit said two biasing components to be seated co-axial with said vertical holes and to connect to said two vertical rods in the longitudinal sliding direction in said seat body.

4. The retractable horn cleat device as claimed in claim 2, wherein a groove is disposed at a top of said seat body corresponding to a position exactly below said transverse rod of said retractable handle and adapted to receive and substantially conceal said transverse rod.

5. The retractable horn cleat device as claimed in claim 2, wherein said cross-bar is transversely connected to each of said two vertical rods, and the coupling member is connected to the cross-bar.

6. The retractable horn cleat device as claimed in claim 5, wherein the cross-bar is surrounded with a block through which said cross-bar extends, and the coupling member is connected to the block.

7. The retractable horn cleat device as claimed in claim 6, wherein a recess is provided at the inside top of the receiving cavity corresponding to the block so that an upper part of the block is contained in the recess when the cross-bar moves upward and makes contact with the top of the receiving cavity.

8. The device as claimed in claim 1, wherein the two biasing components are a pair of springs.

* * * * *